US008636329B1

(12) United States Patent
Hug

(10) Patent No.: US 8,636,329 B1
(45) Date of Patent: Jan. 28, 2014

(54) SLIDING CABINET DRAWER KIT WITH DRAWER SHIELD AND METHOD OF INSTALLATION

(71) Applicant: Lawrence J. Hug, Parker, CO (US)

(72) Inventor: Lawrence J. Hug, Parker, CO (US)

( * ) Notice: Subject to any disclaimer, the term of this patent is extended or adjusted under 35 U.S.C. 154(b) by 0 days.

(21) Appl. No.: 13/729,478

(22) Filed: Dec. 28, 2012

(51) Int. Cl.
*A47B 96/00* (2006.01)

(52) U.S. Cl.
USPC ..... 312/270.3

(58) Field of Classification Search
USPC ..... 312/270.1, 270.3, 291, 301, 348.1, 312/348.3, 348.5
See application file for complete search history.

(56) References Cited

U.S. PATENT DOCUMENTS

| | | | | | |
|---|---|---|---|---|---|
| 308,156 | A * | 11/1884 | Hamilton | 312/270.3 |
| 333,245 | A * | 12/1885 | Newlin | 312/270.3 |
| 688,010 | A | 12/1901 | Simmons | |
| 800,040 | A * | 9/1905 | Wilmot | 312/270.1 |
| 923,165 | A * | 6/1909 | Goldman | 312/31 |
| 952,699 | A * | 3/1910 | Brien | 312/270.3 |
| 1,421,515 | A * | 7/1922 | McKnight | 312/348.3 |
| 1,443,352 | A * | 1/1923 | Dysthe | 312/270.3 |
| 2,227,892 | A * | 1/1941 | Soldan | 312/107 |
| 2,237,820 | A * | 4/1941 | Hill | 62/466 |
| 2,701,174 | A * | 2/1955 | Franks | 312/263 |
| 2,769,677 | A * | 11/1956 | Courson et al. | 312/308 |
| 2,846,286 | A * | 8/1958 | Gomersall | 312/270.3 |
| 2,947,589 | A * | 8/1960 | Darbo | 312/301 |
| 3,272,580 | A * | 9/1966 | Dean et al. | 312/409 |
| 3,528,718 | A * | 9/1970 | Braun et al. | 312/308 |
| 4,156,549 | A * | 5/1979 | Clark | 312/270.3 |
| 5,037,165 | A * | 8/1991 | Rapp et al. | 312/330.1 |
| 5,222,789 | A * | 6/1993 | Yoshikawa | 312/270.3 |
| 5,393,136 | A * | 2/1995 | Grabowski et al. | 312/184 |
| 6,309,039 | B1 * | 10/2001 | Park et al. | 312/258 |
| 6,428,129 | B1 * | 8/2002 | Chen | 312/348.1 |
| 7,699,414 | B1 * | 4/2010 | Shevrin | 312/291 |
| 2002/0171343 | A1 * | 11/2002 | Miller et al. | 312/348.1 |
| 2003/0222552 | A1 * | 12/2003 | Wessel | 312/278 |
| 2008/0007147 | A1 * | 1/2008 | Skog | 312/270.3 |

* cited by examiner

*Primary Examiner* — Hanh V Tran
(74) *Attorney, Agent, or Firm* — Edwin H. Crabtree; Ramon L. Pizarro

(57) ABSTRACT

A sliding cabinet drawer kit for installing on top of a sliding drawer received inside a drawer cabinet and for greatly reducing if not eliminating entrance into the drawer by mice, lizards and like size rodents and insects. The drawer kit includes a pair of drawer slide rails adapted for attachment to a top portion of opposite vertical side panels of a sliding open top cabinet drawer. A thin sheet, plastic drawer shield is cut to size for covering the open top in the drawer. Opposite sides of the shield are slidably received next to the slide rails. The drawer shield includes a shield attachment block with predrilled screw holes and threaded screws mounted on an end portion of the shield. The attachment block is used for securing the shield to a back of a cabinet.

6 Claims, 2 Drawing Sheets

SLIDING CABINET DRAWER KIT WITH DRAWER SHIELD AND METHOD OF INSTALLATION

BACKGROUND OF THE INVENTION (a) Field of the Invention

This invention relates to reducing and if not eliminating large insects and rodents, particularly mice, from entry into an open top, sliding cabinet drawer and more particularly but not by way of limitation, to a kit and a method for installing a drawer shield on top of the open top cabinet drawer to prevent access into the drawer when the drawer is closed inside a cabinet.

(b) Discussion of Prior Art

Heretofore, homeowners and businesses in certain areas of the country are faced with the ongoing problem of insects and rodents invading closed cabinet drawers looking for food, building a nest, and the like. Obviously, mouse traps and rodent poison can be used, but traps and poison are unacceptable around food and cooking utensils stored in a drawer. Also, the use of mouse traps and rodent poison is only a temporary solution and does not provide continuous protection from potential entry into open top, sliding cabinet drawers by rodents and large insects.

In the past, cabinet drawers have been made with a hinged drawer cover that sides out with the drawer. The hinged drawer cover then must be lifted separately to gain access inside the drawer. In U.S. Pat. No. 688,010 to Simmons, a dust and mouse proof drawer case is disclosed. In this early patent, an "L" shaped drawer plate is used to cover the open top of a sliding drawer. One end of the drawer plate is attached to a horizontal rail in front of a drawer cabinet. An opposite end, with a right angle bend, of the drawer plate is received next to a rear end of the drawer, when the drawer is closed inside the cabinet. This type of drawer plate, as described in the Simmons patent, is not completely seal proof and can be easily lifted upwardly by an insect or rodent for gaining access into the drawer.

The subject invention uses sliding rails for engaging opposite sides of a drawer shield. The drawer shield completely covers the open top of the drawer when closed and therefore helps discourage rodents and large insects access therein.

SUMMARY OF THE INVENTION

In view of the foregoing, it is a primary object of the subject invention to help discourage and potentially prevent large insects and rodents, particularly mice, from entry into a sliding, open top, cabinet drawer, when the drawer is closed inside a cabinet.

Another object of the invention is to provide a drawer kit for ease in installation on different sizes of sliding cabinet drawers. The invention provides for complete access to the drawer when opened. Also, the drawer kit can be used for retrofitting existing drawers or for new cabinet drawer installations.

Still another object of the invention is the use of a drawer shield made of a lightweight, durable, thin sheet plastic. The sides of the shield slide easily inside a pair of rails mounted on top of the vertical sides of the drawer. Also, the drawer shield is easily attached to a back of the cabinet without having to measure and mark a location inside the cabinet.

The subject invention includes an installation kit having a pair of parallel drawer slide rails adapted for attachment to a top portion of opposite side panels of a sliding open top cabinet drawer. The kit also includes a thin sheet, plastic drawer shield to be cut to size for covering an open top in the drawer. Opposite sides of the shield are slidably received next to the slide rails. The drawer shield includes a shield attachment block, with pre-drilled screw holes. The attachment block is mounted on an end portion of the shield and used for securing the shield to a back of a cabinet.

These and other objects of the present invention will become apparent to those familiar with sliding, open top cabinet drawers and problems related to rodent and insect control inside a home or building when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the sliding cabinet drawer kit, and in which.

DETAILED DESCRIPTION OF THE PREFERRED EMBODIMENTS

Figure 1:
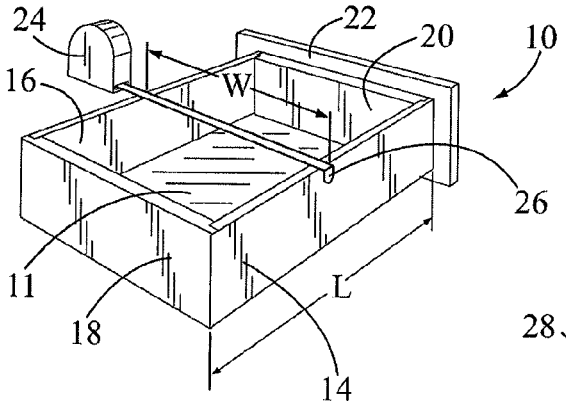
FIG. 1 is a perspective view of a cabinet drawer with a measuring tape used for measuring a width "W" of the drawer. The drawer is also shown having a length "L".

In FIG. 1, a perspective view of a standard cabinet drawer is shown and having general reference numeral 10. The drawer 10 includes an open top 11, a horizontal bottom panel 12, a first vertical side panel 14, a second vertical side panel 16, a vertical rear panel 18 and a vertical front panel 20 with front panel facing 22. In this drawing, a tape housing 24 with a measuring tape 26 is shown measuring a width "W" of drawer 10.

Figure 2:
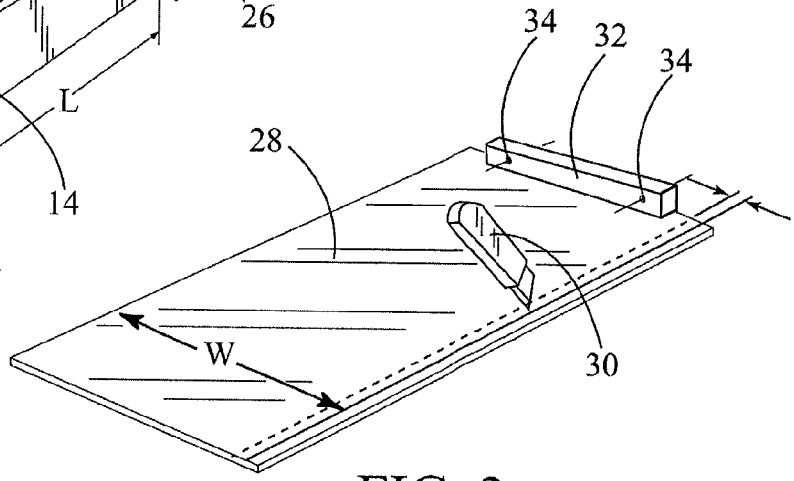
FIG. 2 is a perspective view of a thin sheet, plastic, drawer shield being cut to the width "W" using a knife.
Figure 7:
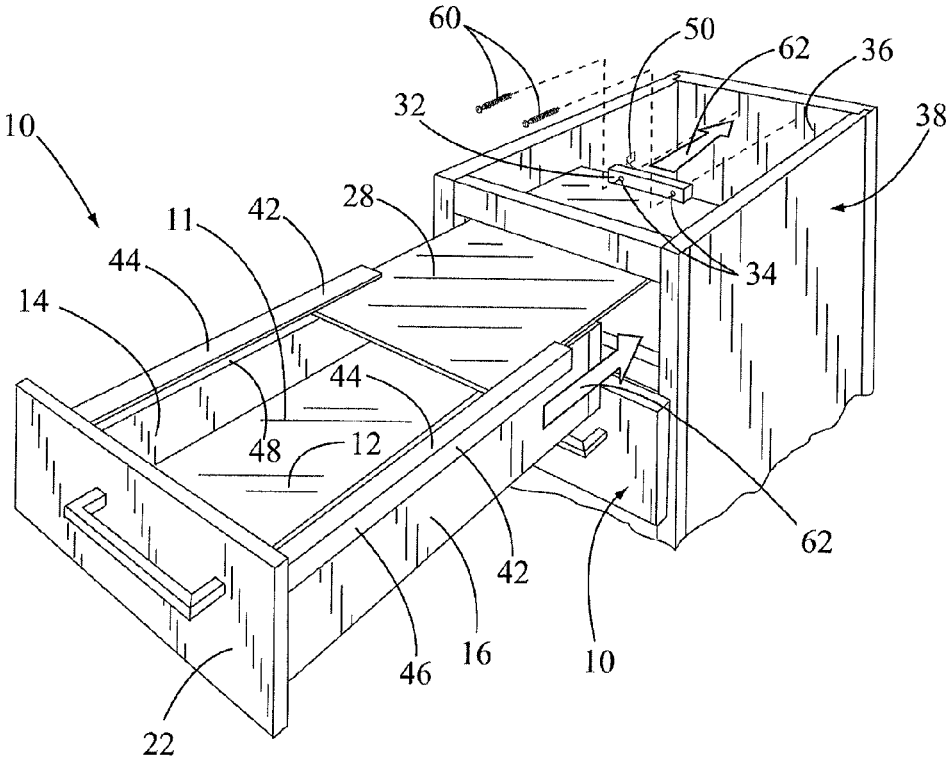
FIG. 7 is a perspective view of the drawer positioned for sliding into the cabinet and for securing the shield temporarily to the back of the cabinet using an adhesive tape and then permanently using threaded screws.

In FIG. 2, a perspective view of a thin sheet, plastic, drawer shield 28 is shown being cut to the width "W" using a knife 30. The shield 28 includes an elongated, upper shield attachment block 32 on an end portion thereof. The attachment block 32 includes pre-drilled screw holes 34 for received screws and attaching the shield to a back 36 of a drawer cabinet, having a general reference numeral 38. The back 36 and the cabinet 38 are shown in FIGS. 3 and 7.

Figure 3:
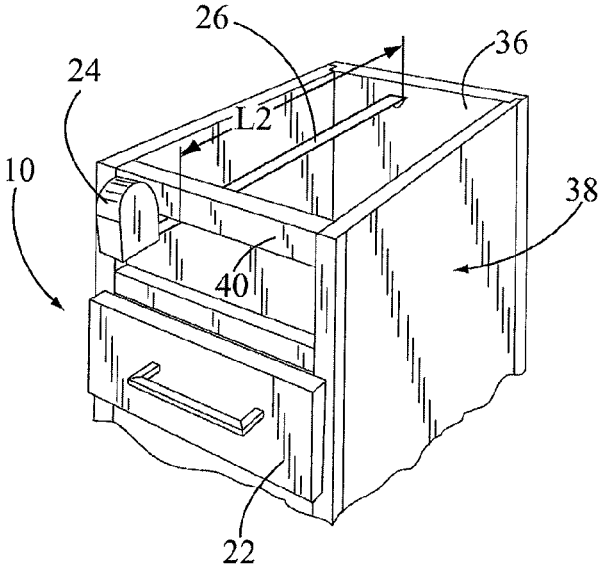
FIG. 3 is a perspective view of a drawer cabinet with a top drawer removed for using the measuring tape to measure a length "L2" from the front or face of the cabinet to the back of the cabinet.

In FIG. 3, a perspective view of the drawer cabinet 38 is shown with a top drawer 10 removed for using the measuring tape 26 to measure a length "L2" from a front 40 of the cabinet 38 to the back 36 of the cabinet. The length "L2" is greater than the length "L" of the drawer 10, shown in FIG. 1, and is sufficient to cover the open top 11 of the drawer 10 and extending rearwardly for attachment to the back of the cabinet.

Figure 4:
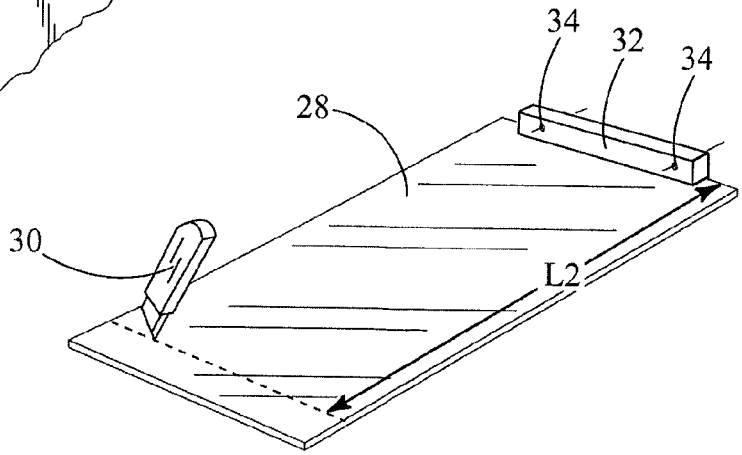
FIG. 4 is another perspective view of the drawer shield being cut to the length "L2", using the knife. The length "L2" is greater than the length "L" of the drawer shown in FIG. 1.

In FIG. 4, which is similar to FIG. 2, another perspective view of the shield 28 is shown being cut to the length "L2", using the knife 30.

Figure 5:
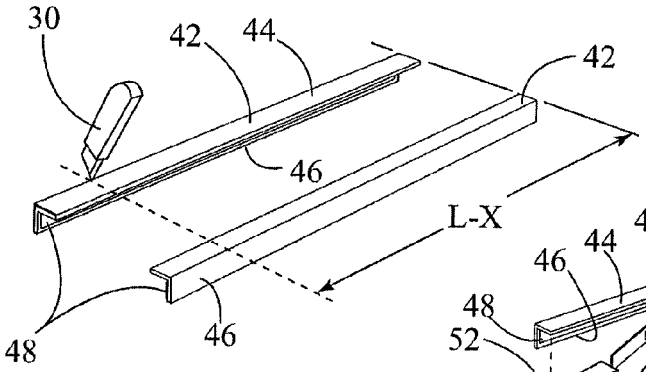
FIG. 5 is a perspective view of a pair of inverted "L" shaped slide rails being cut to a length "L−X", using the knife.

In FIG. 5, a perspective view of a pair of parallel, inverted "L" shaped slide rails 42 are shown being cut to a length "L−X", using the knife 30. The slide rails include a horizontal portion 44 and a vertical portion 46 for slideably engaging a portion of opposite sides of the shield 28, as shown in FIG. 7.

The dimension "X" is typically in a range of 1 to 4 inches. Therefore, the slide rails 42 are 1 to 4 inches shorter than the length "L" of the drawer 10 for ease in inserting the shield 28 between the rails 42 and inside the cabinet 38.

Figure 6:
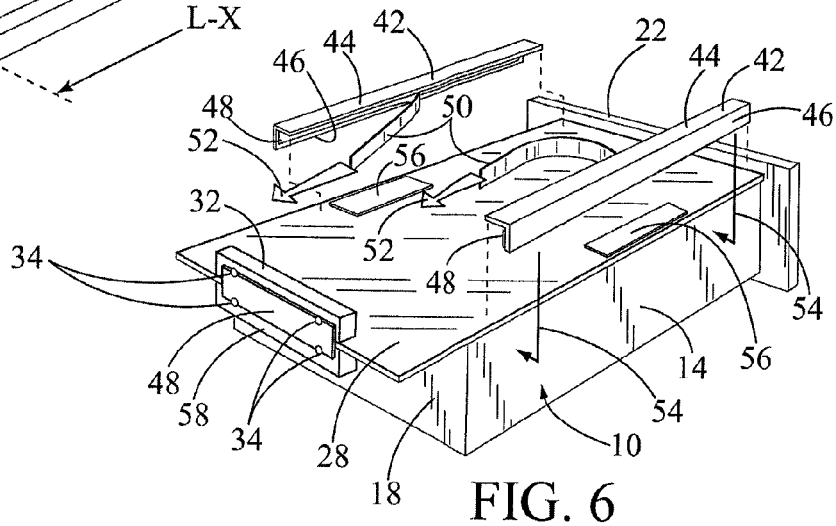
FIG. 6 is a perspective view of the slide rails disposed above vertical side panels of the drawer and positioned for attachment thereto. Also, the shield is shown received over an open top of the drawer.

In FIG. 6, another perspective view of the slide rails 42 are shown and disposed above the vertical side panels 14 and 16 of the drawer 10 and positioned for attachment thereto. An inside of the vertical portion 46 of the rails 42 includes a double-sided adhesive tape 48 with a tape cover 50. In this drawing, the tape cover 50 is shown being peeled away, as indicated by arrows 52, so that the adhesive tape 48 can be used for securing the vertical portion 46 of the rails 42 next to the top of the first and second side panels 14 and 16, as indicated by arrows 54.

Also in this drawing, the shield 28 is shown received over and covering the open top 11 of the drawer 10. During the attachment of the rails 42 to the drawer 10, two temporary cardboard spacers 56 are placed between the top of the shield 28 and the horizontal portion 44 of the two rails 42. The use of the spacers 56 provide for additional space for ease in the rails sliding next to the sides of the sides of the shield. When the rails 42 have been attached to the drawer 10, the spacers 56 are removed. Also shown in this drawing is an elongated, lower attachment block 58 with pre-drilled screw holes 34.

In FIG. 7, a perspective view of the top drawer 10 is shown and positioned for sliding into the cabinet 38 and securing the shield 28 to the back 36 of the cabinet 38 using the adhesive tape 48 on the back of the attachment block 32. In this drawing, the tape cover 50 is shown being peeled away. With the tape cover 50 removed, the adhesive tape 48 on the attachment block 32 will hold the shield 28 temporarily on the back 36 of the cabinet 38. This feature eliminates the need of having to reach inside the cabinet 38 and measure and mark on the back 36 an approximate site for securing the shield 28 thereto. At this time, threaded screws 60 are then received through the screw holes 34 on the attachment block 32 for securing the shield 28 in place to the back of the cabinet.

It should be noted that when a cabinet top has been removed, as shown in FIGS. 3 and 7, the upper attachment block 32 on top of the end portion of the shield 28 can be easily attached to the back 36, using the treaded screws 52. But, if the cabinet top is not removed, a lower drawer 10, shown in FIGS. 3 and 7, can be removed from the cabinet 38 and the screws 52 received through pre-drilled screw holes 34 in the lower attachment block 58, shown in FIG. 6. Also, the upper attachment block 32 can be used with a lower drawer 10 by removing the drawer thereabove in the cabinet 38.

At this time, the installation of the sliding cabinet drawer kit is complete with the opposite sides of the shield 28 sliding next to the rails 42 with the shield completely covering the open top 11 of the drawer 10, when the drawer is closed, as indicated by arrows 62, inside the cabinet 38.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A method for retrofitting an existing cabinet open top sliding drawer or a new cabinet open top sliding drawer and installing a sliding cabinet drawer kit, the drawer kit adapted for mounting on top of a pair of vertical side panels in of the open top sliding drawer, the drawer received inside a drawer cabinet having a cabinet top, the steps comprising:

cutting a thin sheet, drawer shield to a length "L2" and a width "W", the length "L2" and the width "W" sufficient to cover an open top in of the drawer;

attaching an elongated attachment block having pre-drilled screw holes therein to an end portion of the shield;

cutting a pair of slide rails to a length "L−X" and less than a length "L" of the drawer;

attaching the slide rails to the pair of side panels in of the drawer;

placing the shield on top of the drawer and covering the open top of the drawer;

placing opposite sides of the shield next to the slide rails; and attaching the end portion of the shield using the attachment block to a back of the drawer cabinet by (a) securing the attachment block to a top of the end portion of the shield when the cabinet top is removed or an upper drawer disposed above the drawer is removed or (b) securing the attachment block to a bottom of the end portion of the shield by removing a lower drawer disposed below the drawer when the cabinet top and/or the upper drawer is not removed, and closing the drawer inside the drawer cabinet.

2. The method as described in claim 1 wherein temporarily attaching the attachment block to the back of the drawer cabinet using a double-sided adhesive tape prior to using threaded screws for securing the shield to the back of the drawer cabinet the shield is attached to the back of the drawer by removing the cabinet top or removing an upper drawer and using an elongated upper attachment block with pre-drilled screw holes therein and threaded screws.

3. The method as described in claim 1 wherein the rails having an inverted "L" shape configuration with a horizontal portion and a vertical portion, the vertical portion of the rails including a double-sided adhesive tape used for attaching the rails to a top portion of the pair of vertical side panels of the drawer.

4. A sliding cabinet drawer kit for retrofitting an existing cabinet sliding drawer or a new cabinet sliding drawer, the kit adapted for mounting on top of a pair of vertical side panels in an open top of the sliding drawer, the drawer received inside a drawer cabinet having a cabinet top, the drawer kit comprising:

a drawer shield, the shield having a width and a length dimensioned to cover the open top of the drawer;

a pair of slide rails, the slide rails having an inverted "L" shaped configuration with a horizontal portion for receipt above opposite sides of the shield and a vertical portion for receipt next to the opposite sides of the shield, an inside of the vertical portion of the slide rails includes a double-sided adhesive tape for securing the rails to a side of the vertical side panels of the drawer; and an elongated attachment block attached to an end portion of the shield, the attachment block having pre-drilled screw holes therein for receiving threaded screws for securing the shield to a back of the drawer cabinet and, wherein the elongated attachment block is an upper attachment block attached to a top of the end portion of the shield when a the cabinet top has been removed, or an upper drawer above the drawer is removed, or the elongated attachment block is a lower attachment block attached to a bottom of the end portion of the shield when a lower drawer below the drawer is removed, thereby providing access to the attachment block.

5. The drawer kit as described in claim 4 wherein the elongated attachment block includes an upper attachment block attached to a top of the end portion of the shield and a lower attachment block attached to a bottom of the end portion of the shield, the upper and lower attachment blocks having pre-drilled screw holes therein for receiving threaded screws for securing the shield to the back of the drawer cabinet.

6. The drawer kit as described in claim 5 wherein the upper and lower attachment blocks include double-sided tape to temporarily hold the shield to the back of the cabinet prior to using the threaded screws for securing the shield to the back of the drawer cabinet.

* * * * *